US007387404B2

(12) United States Patent
Waldmann

(10) Patent No.: US 7,387,404 B2
(45) Date of Patent: Jun. 17, 2008

(54) PROTECTIVE TUBULAR LIGHT WITH MULTI-PART COVERS

(75) Inventor: Gerhard Waldmann, Dauchingen (DE)

(73) Assignee: Herbert Waldmann GmbH & Co. KG, Villingen-Schwenningen (DE)

( * ) Notice: Subject to any disclaimer, the term of this patent is extended or adjusted under 35 U.S.C. 154(b) by 60 days.

(21) Appl. No.: 11/116,309

(22) Filed: Apr. 28, 2005

(65) Prior Publication Data

US 2005/0243555 A1 Nov. 3, 2005

(30) Foreign Application Priority Data

Apr. 30, 2004 (DE) ..... 10 2004 021 345

(51) Int. Cl.
*H01R 33/20* (2006.01)

(52) U.S. Cl. ..... 362/222; 362/267; 362/645; 362/657

(58) Field of Classification Search ..... 362/217, 362/221, 222, 223, 260, 267, 285, 376, 377, 362/378, 422, 424, 640, 645, 649, 650, 652, 362/655, 656, 657, 659; 439/230, 234, 239, 439/242

See application file for complete search history.

(56) References Cited

U.S. PATENT DOCUMENTS 5,599,090 A 2/1997 Waldmann 6,039,460 A * 3/2000 Ng et al. ..... 362/267

FOREIGN PATENT DOCUMENTS

| | | |
|---|---|---|
| DE | 7129201 | 7/1971 |
| DE | 37 40 701 A1 | 6/1989 |
| DE | 295 00 849 U1 | 4/1995 |
| DE | 195 01 327 C2 | 10/1999 |
| DE | 100 10 518 C2 | 9/2002 |
| DE | 102 19 328 A1 | 11/2003 |
| DE | 102 36 183 A1 | 2/2004 |
| DE | 202 18 557 U1 | 5/2004 |

* cited by examiner

*Primary Examiner*—Y. My Quach-Lee
(74) *Attorney, Agent, or Firm*—The Nath Law Group; Jerald L. Meyer; Stanley N. Protigal

(57) ABSTRACT

A protective tubular light is proposed, which basically consists of a transparent light tube (10) in which a fluorescent lamp is positioned. The fluorescent lamp is carried by a lamp support. The light tube (10) can be tightly sealed on either end by a cover consisting of an outer cover part (60) and an inner cover part (80). Serving to produce the tight seal is a sealing ring (62), which is pressed against the inner wall of the light tube (10) by the axial movement of the inner cover part (80) in conjunction with a tension cone (83) furnished on the inner cover part (80). The electrical connection of the fluorescent lamp and the network cable is provided by plug and coupling parts (30, 40). To produce or break off the electrical connection the coupling part (40) is driven against or withdrawn from the plug part (30) by the inner cover part (80), which can be moved axially.

16 Claims, 5 Drawing Sheets

PROTECTIVE TUBULAR LIGHT WITH MULTI-PART COVERS

Figure 1:
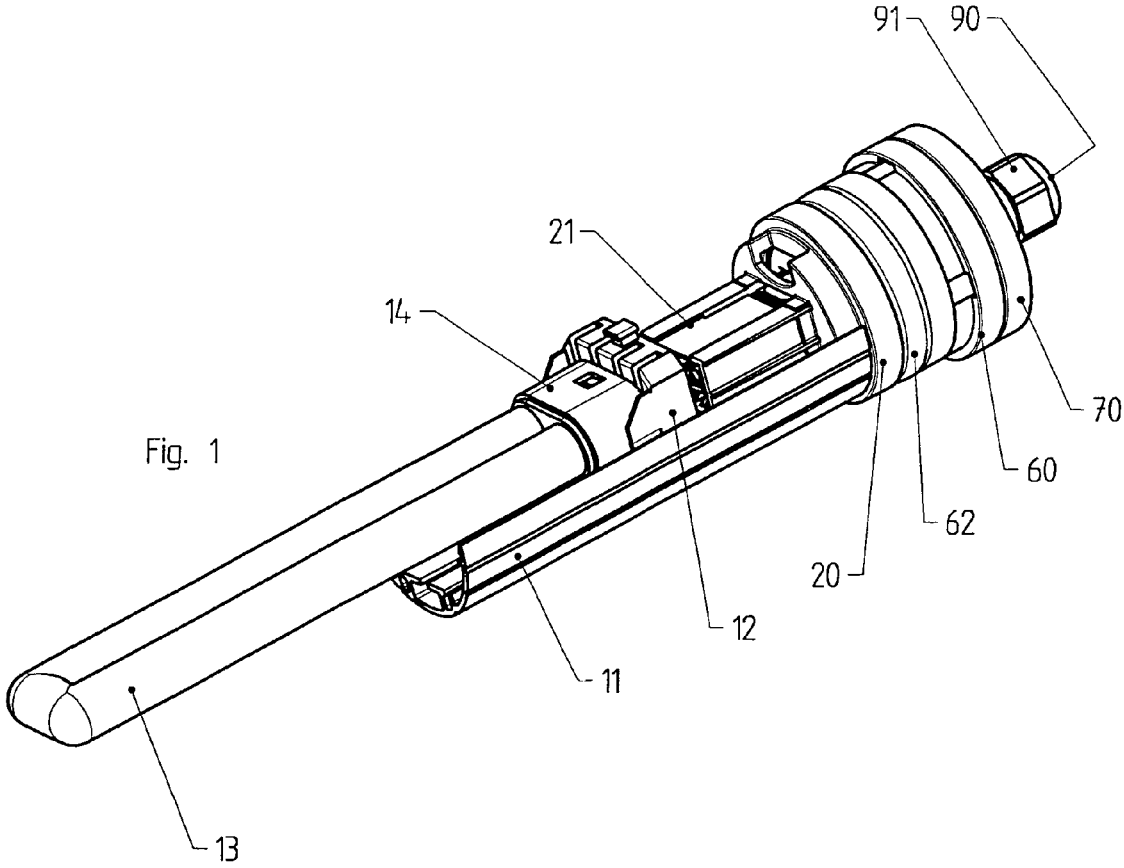

The subject matter of the invention is a protective tubular light of the type having multi-part covers consisting of a transparent light tube, a lamp positioned therein, and a lamp support whose mountings support the lamp, such that the multi-part covers seal the light tube.

The invention proceeds from the lights known from DE 195 01 327 C2. Similar lights are known from DE 102 19 328 A1, DE 100 10 518 C2, and DE-GM 71 29 201.

Lights of this kind basically exhibit a transparent light tube of glass or plastic, which is sealed on either side with cover parts that are inserted into the open ends of the tube. Inside of the tube the means of illumination—customarily a fluorescent lamp, along with its mountings and the structural elements necessary for operation, for example, chokes, starters, and the like—are positioned on the lamp support, which is usually a supporting section.

Since the protective tubular light is to be employed in spaces laden with moisture or even, in certain circumstances, under water, it is of decisive importance to provide the cover parts with a tight seal. The opening and closing of the light while it is plugged in or being replaced can also be problematic.

As a result, it is customary to use two-part covers equipped with sealing rings. With the aid of tension cones applied to the cover parts, the sealing ring is pressed radially and outwards against the inner wall of the light tube when the cover parts are pulled together, thereby sealing the light.

In actual practice, this design has resulted in various shortcomings.

When the covers are opened or closed the turning motion of the cover parts can be transmitted to the lamp support and may rotate the lamp support itself, with the result that lamp is not always correctly positioned. Furthermore, the electrical leads and their connecting contacts may be twisted and damaged due to frequent turning.

Moreover, short circuits may arise when the lamp is replaced in cases where the power supply is not interrupted.

Finally, for large tolerances in the light tubes as determined by manufacturing conditions, the needed seal is not always provided, since in some cases the tension cones with the sealing rings cannot bridge the arising differences.

Consequently the present invention is based on the problem of creating a light that is free of the above-mentioned deficiencies, to thereby provide a light that is more easily assembled and serviced.

This problem is solved by the features of claim 1.

A two-part sealing cover with an adjusting ring is proposed in which a plug part and a coupling part are provided for the purpose of electrical connection, and these parts are engaged or disengaged by turning the adjusting ring. At the same time, a sealing ring which can be widened in the radial direction provides a seal with the needed degree of tightness.

The advantage of the cover according to the invention rests in the fact that when the cover is opened or closed by rotating the adjusting ring, an axial motion of the two cover parts toward or away from each other is executed, with the result that the electrical plugs or coupling parts connected to these two cover parts are automatically joined or separated. Upon removal of the lamp the current circuit is automatically interrupted if the cover is opened and removed.

To connect the light, the lamp support, with the lamp and the other electrical components, may remain inside the light tube, since the electrical connection occurs by actuation of the two-part cover. Rotation of the adjusting ring does not cause the inner cover part to execute turning motions that could be transmitted to the lamp support.

Further structural measures for securing the coupling part and the plug part are specified in claims 2 to 5.

The design of the sealing ring is the subject matter of claims 6 and 7.

Means for converting the turning movement of the adjusting ring into an axial movement of the inner cover part and for facilitating the assemblage process are contained in claims 8 to 11 and 14.

The proposals according to claims 12 and 13 serve to protect the light tube when the cover is installed.

Finally, claim 15 relates to the cable guidance realized in the cover according to the invention, while claim 16 proposes for protective tubular light according to the invention a more easily operated adjusting ring in the case of contamination by dirt.

Figure 2:
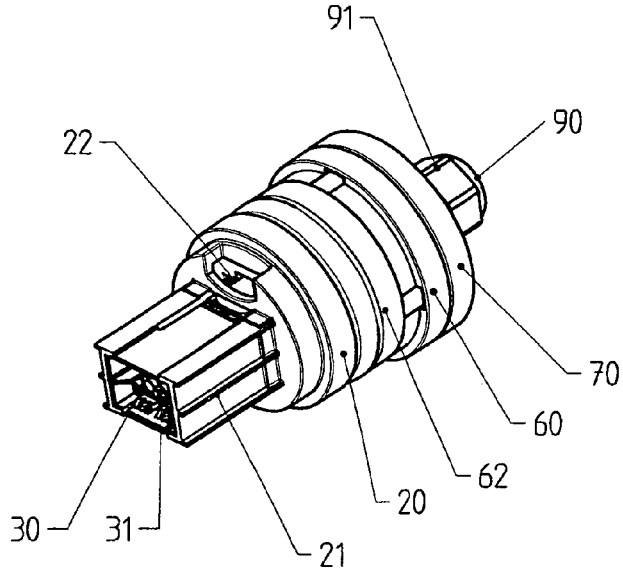
Figure 3:
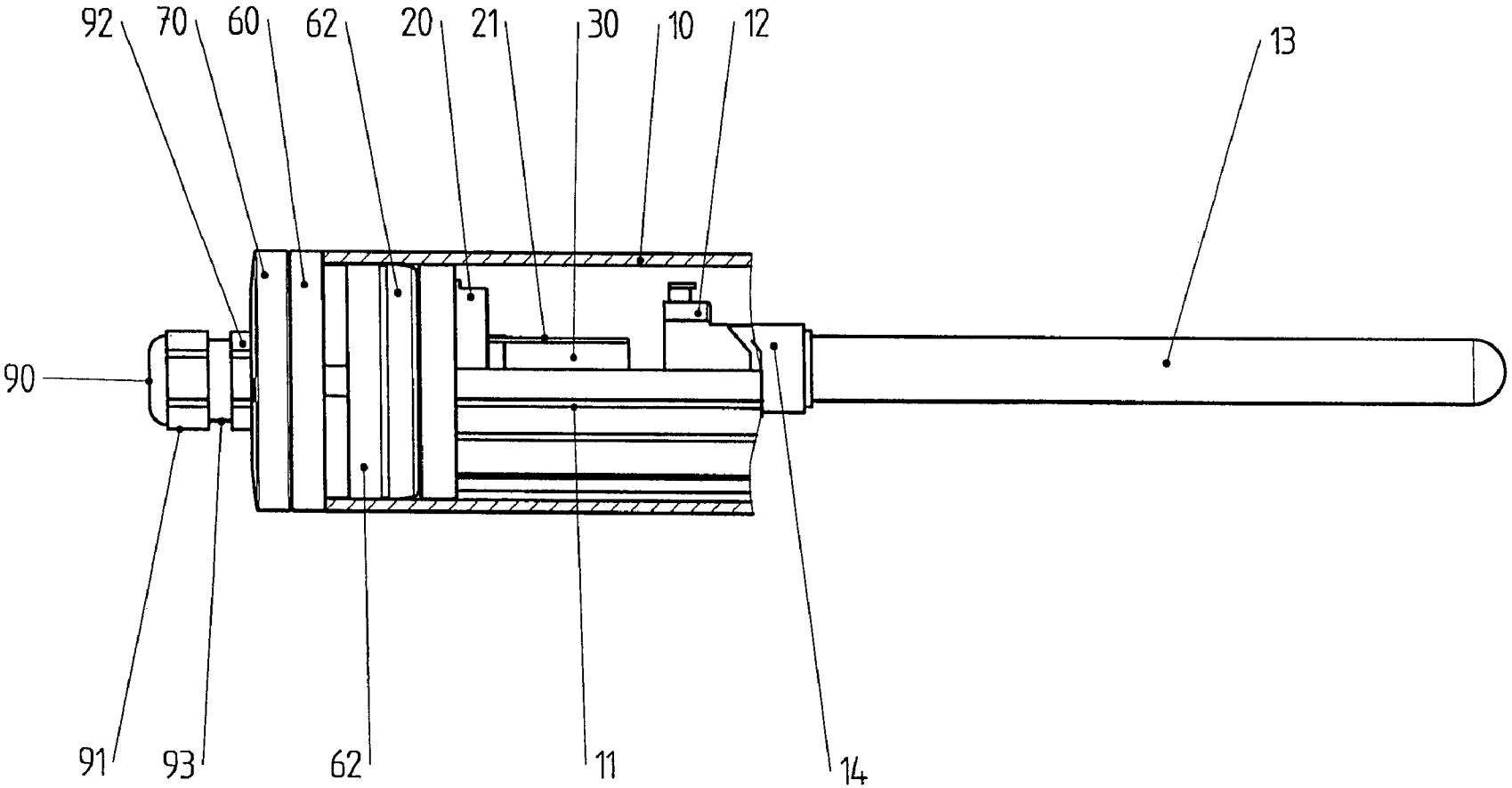
Figure 4:
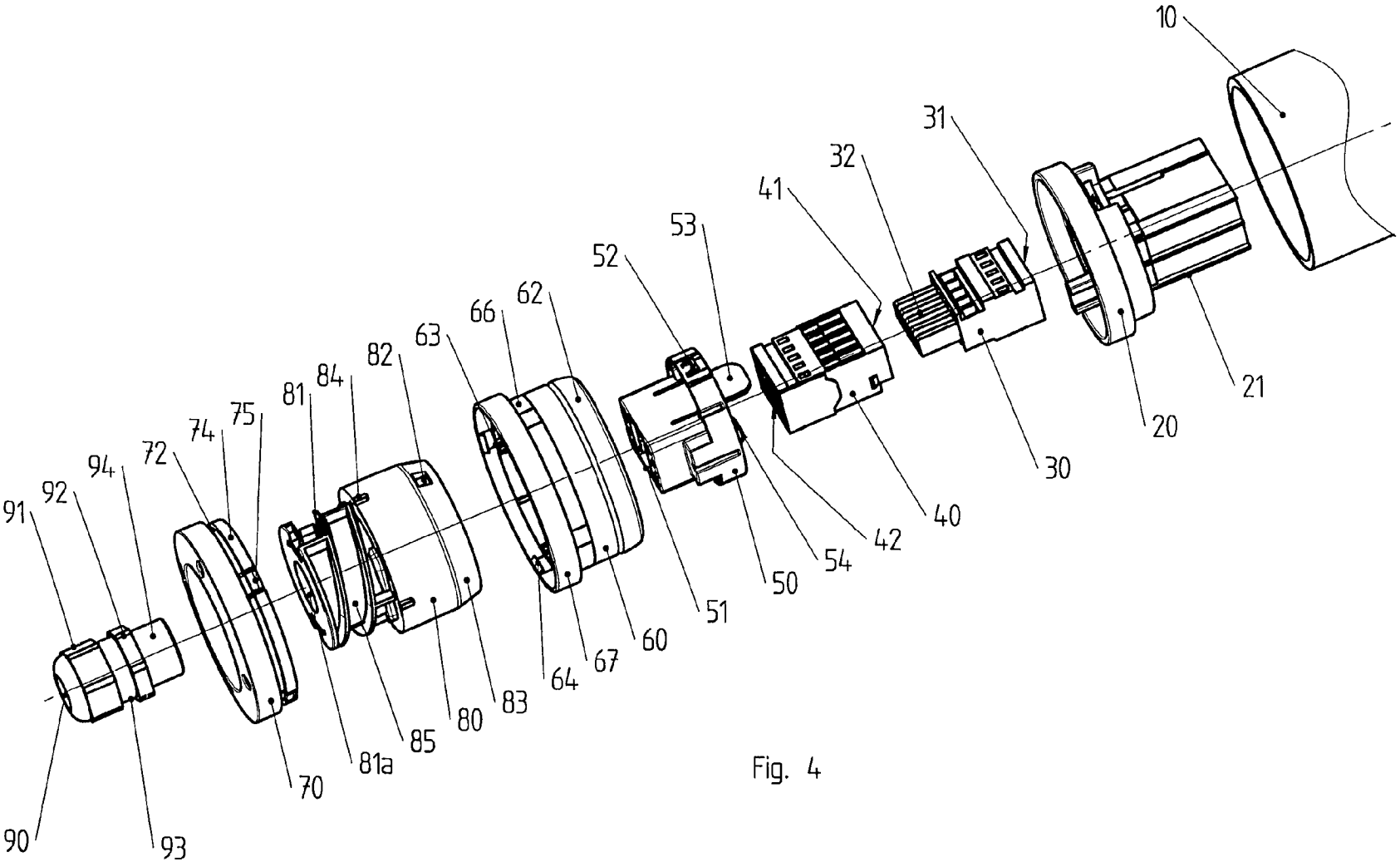
Figure 5:
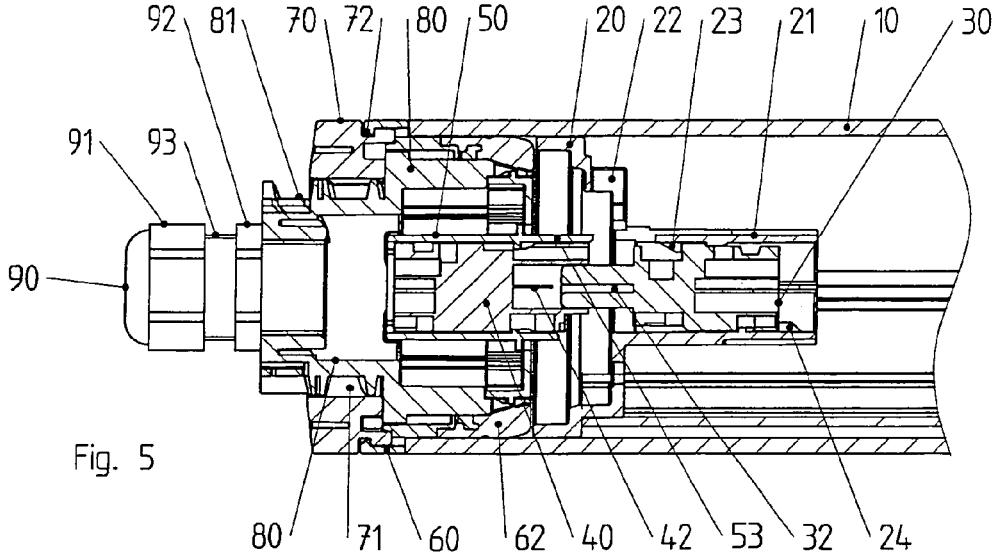
Figure 6:
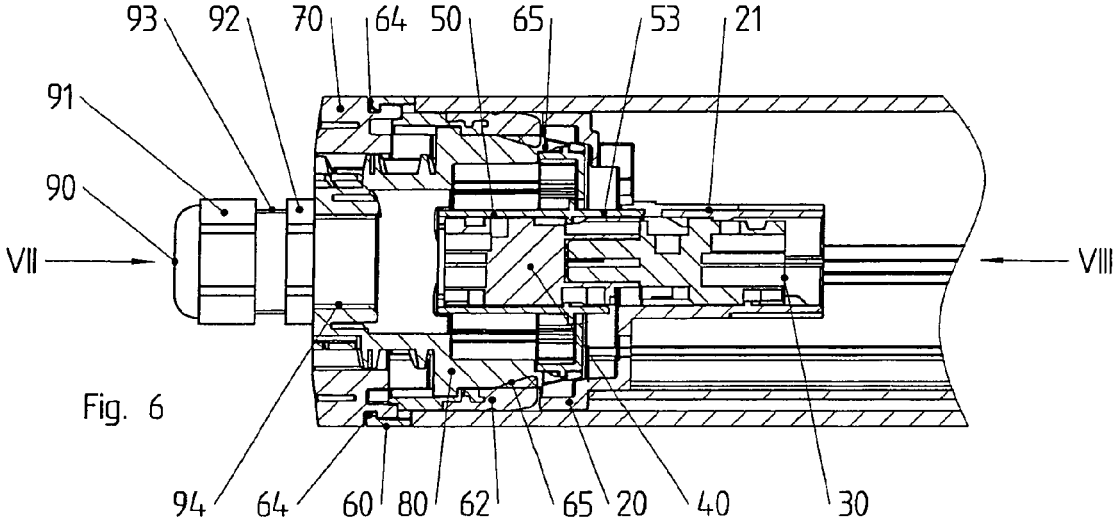
Figure 7:
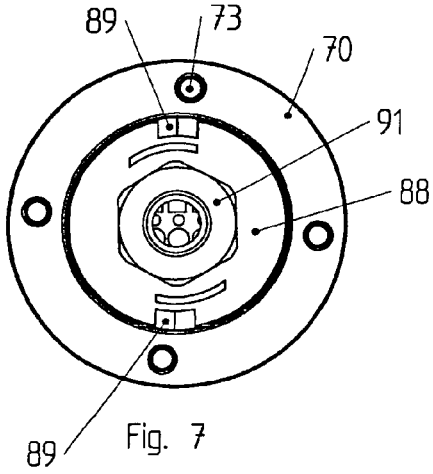
Figure 8:
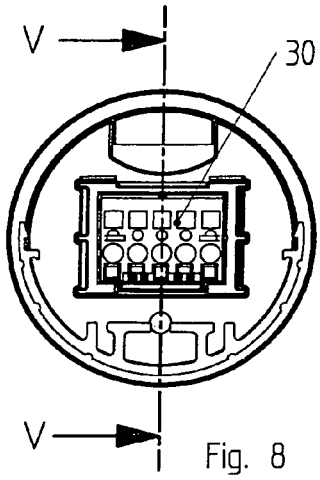
Figure 9:
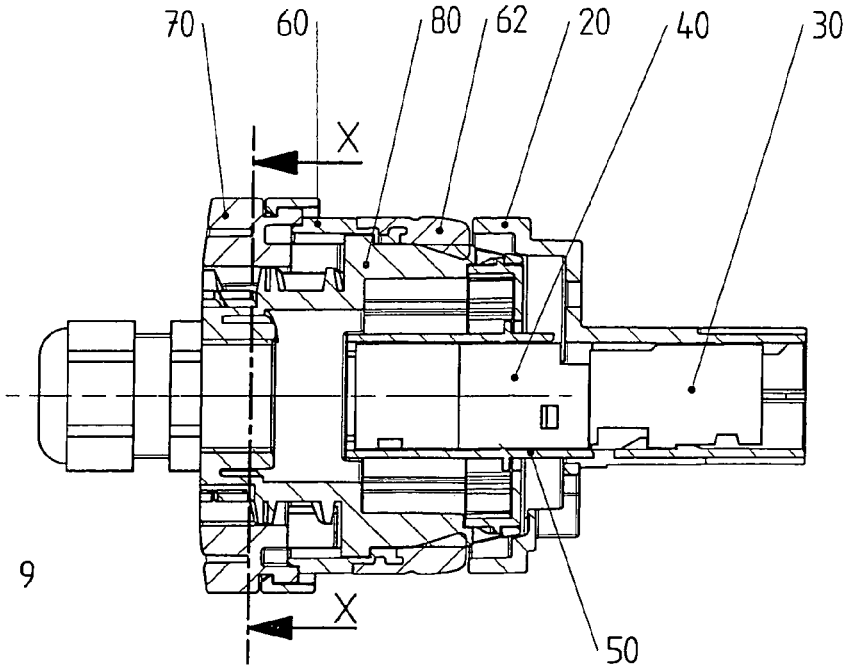

For the rest, all the features claimed are depicted in the drawing and are described in greater detail on the basis of an exemplary embodiment of a protective tubular light. Shown are:

FIG. 1 a perspective view of the cover according to the invention, including the lamp and lamp support FIG. 2 a perspective view of the cover according to FIG. 1, without the lamp and lamp support FIG. 3 a longitudinal section of the configuration according to FIG. 1, but with the light tube depicted in truncated form FIG. 4 an exploded perspective view of the elements of the cover according to the invention, with the light tube sketched in lightly FIG. 5 a section along line V-V of FIG. 8, with the plug in opened condition FIG. 6 a section like that of FIG. 5, with the plug inserted FIG. 7 a front view of the configuration of FIG. 6 in the direction of VII FIG. 8 a back view of the configuration of FIG. 6 in the direction of VIII FIG. 9 a partially sectioned view of the side of the cover according to the invention, in the position shown in FIG. 6

Figure 10:
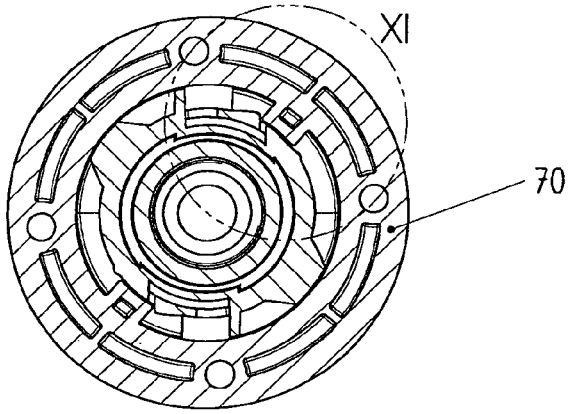

FIG. 10 a section along line X-X in FIG. 9

Figure 11:
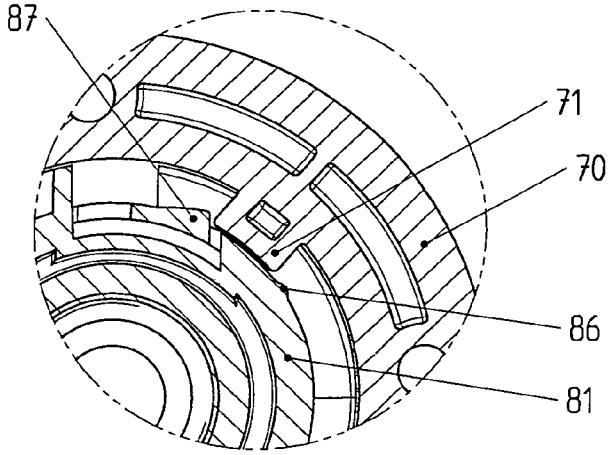

FIG. 11 enlarged detail XI from FIG. 10.

FIGS. 1 to 3 indicate the basic elements of the protective tubular light embodied in accordance with the invention, shown in assembled condition.

In FIG. 1 the cover, with the outer cover part 60, can be identified, as can the sealing ring 62, the adjusting ring 70, and the plug-part holder 20. This cover is installed in the transparent light tube 10, which is not shown in FIG. 1, but is partially shown in FIG. 3. Inserted into the plug seat 21 of the plug-part holder 20 is the plug part 30 identifiable in FIG. 2, which is electrically and mechanically connected to the mounting 12. The fluorescent tube 13 is inserted into the mounting 12 with its base 14; in the present case the fluorescent tube 13 has a base on one side only. The mounting 12 and any other components necessary for the operation of the fluorescent tube, e.g., chokes, starters, and the like, are attached to the lamp support 1, which is also positioned inside the transparent light tube 10.

Openings 22 in the plug-part holder 20 provide access to the locking means for the plug 30 and the lamp support 11.

For the network cable (not depicted) a cable lead-through 90 is applied to the inner cover part 80; this feature can only be identified by its cap nut 91 in FIGS. 1 and 2.

An identical cover structure is provided for sealing the other end (not shown) of the light tube. If there is a unilateral cable lead, the cable lead-through can naturally be omitted.

While FIG. 3 shows the protective tubular light in assembled condition (where the mounting 12 and the fluorescent tube 13 are shifted to the right for the sake of a more graphic representation), FIG. 4 shows in detail the individual parts of the cover that is to be inserted into the light tube 10.

In particular this involves the following elements, seen from right to left:

The plug-part holder 20 with the plug seat 21 molded to it.

The plug part 30, which can be inserted into the plug and engages with it. On its right side the plug part 30 is provided with contacts 31 to enable connection to the lamp mounting 12, as can be seen in detail in FIGS. 1 and 2. On the left side the plug 30 has axially oriented plug contacts 32.

The coupling part 40, with coupling contacts 41 assigned to the plug contacts 32. On the opposite side are pinch contacts (not shown in detail) for connecting the network cable (also not shown).

The coupling-part holder 50, with a recess into which the coupling part 40 is inserted. The coupling part 40 is held in place by spring tabs 53 that enclose it.

On its left side the coupling-part holder 50 has a locking collar 51 for positioning the coupling part 40. The locking tabs 52 enable connection with the inner cover part 80, in the process of which they engage in click-in holes 82 belonging to the inner cover part 80.

The outer cover part 60, whose cylindrical ring 66 is located inside the light tube 10 upon assembly and which carries the sealing ring 62 consisting of an elastic rubber material. Upon assembly its control ring 67 is located outside the light tube 10.

The inner cover part 80, which is inserted into the outer cover part 60. On its right side it exhibits a tension cone 83, while a threaded part 81 is provided on its left side.

The adjusting ring 70, which is screwed onto the threaded part 81 of the inner part 80. By means of the inner ring 74 it is connected to the control ring 67 of the outer cover part 60, in axially secure but rotating fashion. In the process, the projections 64 of the outer cover part 60 engage with the annular groove 72 of the adjusting ring 70. Mounting tabs 75, which are assigned to the projections 64 of the outer cover part, make it possible to snap the inner ring 74 into the control ring 67 of the outer cover part 60.

The cable lead-through 90 with the cap nut 91, threaded tube 93, and fastening nut 92. Upon assembly the connecting piece 94 is inserted into the cylindrical recess 81*a* of the inner cover part 80, and is attached either through screwing or adhesion.

The design and operation of the electrical connection involving the plug part 30 and the coupling part 40 are essential to the invention and are explained in greater in the following on the basis of FIGS. 5 and 6. While FIG. 5 depicts the plug, with plug part 30, and the coupling part 40 in open condition, the plug in closed condition can be seen in FIG. 6.

The plug part 30 connected to the fluorescent lamp 13 is inserted into the seat 21 of the plug-part holder 20, such that the locking projections 23 and 24 hold the plug in position.

Assigned to the plug is the coupling part 40, which is fixed in a recess 54 in the coupling-part holder and is secured, along with the coupling-part holder, against axial displacement by the spring tabs 53. The plug-part holder 20 is connected to the inner cover part 80 in the axial direction and is rotationally secure, such that the locking tabs 52 of the coupling-part holder 50, shown in greater detail in FIG. 4, engage with the click-in holes 82 of the inner cover part 80. Displacement of the inner cover part 80 thus brings about the axial advance or retreat of the coupling part 40 relative to the plug part 30, with the result that the coupling contacts 41 of the coupling part 40 engage or disengage with the contacts 32 of the plug part 30.

The threaded part 81, which engages with the cams 71 of the rotating adjusting ring 70, serves to axially advance the inner cover part 80. Rotating the adjusting ring 70 causes the inner cover part 80, along with the coupling part 40, to advance from the disengaged position shown in FIG. 5 to the engaged position shown in FIG. 6. During this process the plug-part holder 20, with the plug part 30, as well as with the lamp support not shown in FIGS. 5 and 6, remain immobile. Guide grooves 63 on the inside of the outer cover part 60, which guide the cams 84 of the inner cover part 80, prevent the cover parts from twisting against each other. The electrical contact with the fluorescent tube is thus produced. By turning the adjusting ring 70 in the opposite direction the electrical connection is interrupted.

The adjusting ring 70 is secured permanently, but in a manner that permits rotation, by the projections 64 provided on the outer cover part 60; these projections 64 point inward and engage with the annular groove 72.

On its front end, the outer cover part 60 is provided with a sealing ring 62; the tension cone 83 of the inner cover part 80 rests on the inner cone 65 of this sealing ring 62. With the inward axial movement of the inner cover part 80, consequently, not only is the coupling part 40 advanced, but the sealing ring 62 is simultaneously pressed against the inner wall of the light tube 10 due to the effect of the cones 83 and 65 resting against each other. This configuration permits a relatively large expansion of the sealing ring 62, with the result that a secure seal is provided, even when there are comparatively large tolerances in the light tube.

The cover design according to the invention thus offers two advantages, namely the interruption of the electrical contact between the network cable and the fluorescent tube; and a simple and secure seal for the cover relative to the light tube, with the simultaneous provision of electrical contact.

The cable lead-through 90, with its cap nut 91 screwed onto the threaded tube 93, is of conventional design and requires no further explanation. The threaded tube 93 is screwed into, or glued to, a corresponding recess 81 a in the inner cover part 80 by means of a connecting member 94. When the threaded tube is screwed in, a fastening nut 92 provided on the cover-side end permits assembly and disassembly by means of a simple fork wrench.

The face of the adjusting ring 70 exhibits pocket holes 73 over its circumference; these serve to receive a pin wrench or comparable tool in order to better operate the adjusting ring 70 if it has grown resinous or dirty after to extended use.

Another feature of the adjusting ring is explained on the basis of FIGS. 9 to 11.

To avoid damage to the light tube the advance of the inner cover part 80 in the direction of the light tube should be restricted in a way the user can identify.

This end is served by a notch created by the notched cam 86 and the spring projection 87 on the threaded part 81 of the inner cover part 80. The cams 71 of the adjusting ring 70 enter this notch in the terminal position of the closed cover. The notched cam 86 has dimensions such that it can be overrun by the radially retreating cams 71 when the adjusting ring 70 is turned, but in a way the user can clearly identify. The further rotational movement of the adjusting ring 70 is restricted by a radially active spring projection 87 in the base of the thread. This projection can also be overrun when the adjusting ring 70 is turned further, with the result that the cams 71 reach an area of openings 89 which correspond to them in the inner cover part 80. This makes it possible to withdraw the adjusting ring 70 for disassembly over the outer wall 88 of the inner cover part 80.

LIST OF REFERENCE NUMERALS

10 light tube
11 lamp support
12 mounting
13 fluorescent tube
14 lamp base
20 plug-part holder
21 plug seat
22 openings
23 notched projections
30 plug part
31 connection contacts
32 plug contacts
40 coupling part
41 coupling contacts
42 pinch contacts
50 coupling-part holder
51 locking collar
52 locking tabs
53 spring tabs
54 recess
60 outer cover part
62 sealing ring
63 guide groove
64 projections
65 inner cone
66 cylindrical ring
67 control ring
70 adjusting ring
71 cam
72 annular groove
73 pocket hole
74 inner ring
75 mounting tab
80 inner cover part
81 threaded part
81*a* cylindrical recess
82 click-in holes
83 tension cone
84 cam
85 thread
86 notched cam
87 spring tab
88 outer wall
89 openings
90 cable lead-through
91 cap nut
92 fastening nut
93 threaded tube
94 connecting piece

The invention claimed is:

1. Protective tubular light with multi-part covers (60, 70, 80), consisting of a transparent light tube (10), a lamp (13) positioned therein, and a lamp support (11) whose mountings (12) support the lamp (13), such that the multi-part covers (60, 70, 80) tightly seal the light tube (10) at both ends and consist of an outer cover part (60) installed on the light tube (10), an inner cover part (80) which meshes into the outer cover part (60) and exhibits a threaded part (81), and an adjusting ring (70), which is mounted onto the threaded part (81) and whose cams (71) engage with the threaded part (81), and such that axial displacement of the inner cover part (80) relative to the outer cover part (60) causes expansion of a sealing ring (62) by a tension cone (83) so as to cause the sealing ring (62) to press against the inner wall of the light tube (10), and such that an electrical connecting cable runs through one of the two covers (60, 70, 80) and is electrically connected to a coupling part (40) inside the light tube (10), to which coupling part (40) mates with a plug part (30) that is electrically connected to the mounting (12) of the lamp (13), wherein the coupling part (40) is solidly connected to the inner cover part (80) and the plug part (30) is solidly connected to the lamp support (11) and the contacts between the coupling part (40) and the plug part (30) align in an axial direction of the light tube (10) and are positioned in collinear fashion such that the plug part (30) and the coupling part (40) can be connected and disconnected by rotation of the adjusting ring (70).

2. Protective tubular light according to claim 1, wherein the coupling part (40) locks in rotationally secure but detachable fashion with the inner cover part (80) by means of a coupling-part holder (50), and the plug part (30) locks in rotationally secure but detachable fashion with the lamp support (11) by means of a plug-part holder (20).

3. Protective tubular light according to claim 2, wherein a locking collar (51) of the coupling-part holder (50) projects into the inner cover part (80), and radially elastic locking tabs (52) of said coupling-part holder (50) engage with corresponding click-in holes (82) in the inner cover part (80).

4. Protective tubular light according to claim 2, wherein the coupling-part holder (50) exhibits a recess (54) that receives the coupling part (40) and exhibits diametrically positioned spring tabs (53) which enclose the coupling part (40) on either side.

5. Protective tubular light according to claim 2, wherein the plug part (30) rests in a plug seat (21) and is connected to said seat (21) in solid but detachable fashion by locking elements.

6. Protective tubular light according to claim 1, wherein the outer cover part (60), on its side projecting into the light tube (10), exhibits said sealing ring (62) consisting of elastic rubber material and that has an inner cone (65) into which said tension cone (83) formed on the inner cover part (80) is fitted.

7. Protective tubular light according to claim 6, wherein the sealing ring (62) is injected onto the outer cover part (60), which consists of plastic.

8. Protective tubular light according to claim 1, wherein axially extending guide grooves (63) are formed on the interior of the outer cover part (60) and corresponding cams (84) belonging to the inner cover part (80) engage with these guide grooves (63).

9. Protective tubular light according to claim 8, wherein the adjusting ring (70) is connected in axially solid fashion to the outer cover part (60), but can rotate relative to said outer cover part (60).

10. Protective tubular light according to claim 9, wherein the adjusting ring (70) exhibits an inner ring (74) which is mounted in rotating fashion within the outer cover part (60), and the outer cover part (60) has projections (64) which project in radial inward fashion and engage with a circular groove in the adjusting ring (70).

11. Protective tubular light according to claim 10, wherein elastic mounting tabs (75) that serve the purpose of assembly and that correspond to the projections (64) belonging to the outer cover part (60) are formed on the inner ring (74) of the adjusting ring (70).

12. Protective tubular light according to claim 1, wherein the threaded part (81) of the inner cover part (80) exhibits a thread (85) with at least one notch (86) formed on its outside end, into which notch (86, 86) the cam (71) of the adjusting ring (70) fits when the cover (60, 70, 80) is in closed position.

13. Protective tubular light according to claim 12, wherein the notch is formed by a notched cam (86) projecting radially from the base of the thread (85) of the threaded part (81), together with an elastic tab (87) that runs in the rotating direction of the adjusting ring and that extends radially.

14. Protective tubular light according to claim 1, wherein the outside wall (88) of the inner cover part (80) exhibits openings (89) corresponding to the cams (71) of the adjusting ring (70).

15. Protective tubular light according to claim 1, wherein a cable lead-through with a threaded tube (93), a cap nut (91) screwed onto this threaded tube (93), and a fastening nut (92) is connected to the inner cover part (80).

16. Protective tubular light according to claim 1, wherein the adjusting ring (70) exhibits pocket holes which are distributed over its circumference and which are accessible from outside of said tube, for use with a pin wrench.

* * * * *